US011083665B2

(12) United States Patent
Niu

(10) Patent No.: US 11,083,665 B2
(45) Date of Patent: Aug. 10, 2021

(54) PEBBLE BED SAUNA DEVICE

(71) Applicant: MU Global Holding Limited, Kowloon (HK)

(72) Inventor: Yen-Yen Niu, Kowloon (HK)

(73) Assignee: MU GLOBAL HOLDING LIMITED, Kowloon (CN)

( * ) Notice: Subject to any disclaimer, the term of this patent is extended or adjusted under 35 U.S.C. 154(b) by 49 days.

(21) Appl. No.: 16/560,995

(22) Filed: Sep. 4, 2019

(65) Prior Publication Data

US 2021/0059894 A1 Mar. 4, 2021

(51) Int. Cl.
*A61H 15/00* (2006.01)
*A61H 33/06* (2006.01)

(52) U.S. Cl.
CPC ..... *A61H 15/00* (2013.01); *A61H 33/066* (2013.01); *A61H 2033/061* (2013.01); *A61H 2201/0142* (2013.01); *A61H 2201/0207* (2013.01); *A61H 2201/1695* (2013.01)

(58) Field of Classification Search
CPC ..... A61H 33/06; A61H 15/00
USPC ..... 4/524
See application file for complete search history.

(56) References Cited

U.S. PATENT DOCUMENTS 2,752,915 A * 7/1956 Riblet ..... A61H 15/00 601/118
7,481,833 B2 * 1/2009 Dussault ..... A47C 21/048 607/108
10,616,955 B1 * 4/2020 Zack ..... A61N 5/0618

FOREIGN PATENT DOCUMENTS

TW M 469905 U * 1/2014 ..... A61H 33/04

OTHER PUBLICATIONS

English translation of TWM 469905U printed Dec. 18, 2020 (Year: 2020).*

* cited by examiner

*Primary Examiner* — Christine J Skubinna
(74) *Attorney, Agent, or Firm* — Leong C. Lei

(57) ABSTRACT

A pebble bed sauna device includes a bed and a covering chamber movably disposed on the bed. When a human body lies on the bed, the covering chamber may cover, totally or partly, the human body. The bed includes, arranged in sequence from bottom to top, at least one bed heat-isolation member, at least one bed heating member, a plurality of energy stone layers, and a plurality of smooth pebble layers. The covering chamber is formed of at least one surface layer, at least one bonding layer, at least one chamber heat-isolation member, at least one chamber heating member, and at least one heat isolation element that are arranged in sequence from outside to inside and is controlled, for a heating temperature thereof, by a controller arranged on the bed and electrically connected to the bed heating member and the chamber heating member.

4 Claims, 9 Drawing Sheets

PEBBLE BED SAUNA DEVICE

TECHNICAL FIELD OF THE INVENTION

The present invention relates to a pebble bed sauna device, which features omnidirectional heating, excellent security measures, and improved heating/warming effect.

DESCRIPTION OF THE PRIOR ART

Pebble bed sauna generally has a heating source that includes a heating plate arranged in a bed, so that when a user lies on the bend, heating performed with the heating plate makes radium stones warm and hot and emit far infrared light to apply and achieve an effect of pebble sauna, which is also known as stone spa by the general consumers, to human bodies. However, such a manner of generating heating only through the bed may suffer insufficiency area of heating to a human body, which leads to insufficient apparent temperature; oppositely, if temperature rising is made excessively, it would be impossible for a human body to stay in contact with the high-temperature radium stones for an extended period of time. Further, burning events may occur during the operation of the pebble bed sauna. It is quite apparent that protection achieved with security measures may not be perfect.

The pebble sauna, during the use thereof, suffers at least the following disadvantages that require further improvement:

(1) Heating is only made through the bed so that heating to a human body is only applied to a limited local area, and this leads to an apparent temperature that is not sufficient and may affect a heating/warming resonant effect.

(2) With only one layer of radium stones on a heating plate, improper control temperature would readily cause burning.

(3) Security and protection mechanisms for persons or facility are lacking.

SUMMARY OF THE INVENTION

The primary objective of the present invention is to make heating to a human body through both a bed heating member and a chamber heating member, in order to provide an omnidirectional heating effect and to use a thermal isolation member to prevent the human body from contacting the chamber heating member and to add a smooth pebble layer on energy stones to prevent the human body from directly contacting high-temperature stones.

To achieve the above objective, the present invention provides a main structure that comprises: a bed; at least one bed heating member arranged on the bed; at least one bed heat-isolation member arranged between the bed and the bed heating member; a plurality of energy stone layers arranged on one side of the bed heating member that is distant from the bed heat-isolation member; a plurality of smooth pebble layers arranged on one side of the energy stone layer that is distant from the bed heating member; a covering chamber movably disposed on the bed; at least one chamber heating member arranged inside the covering chamber; at least one heat isolation element arranged on one side of the chamber heating member that is adjacent to the bed; at least one chamber heat-isolation member arranged on one side of the chamber heating member that is distant from the heat isolation element; at least one surface layer formed on an outside surface of the covering chamber; at least one bonding layer arranged between the chamber heat-isolation member and the surface layer; and a controller arranged on the bed and electrically connected to the bed heating member and the chamber heating member.

When a user uses the present invention to do pebble bed sauna or stone spa, since the bed heating member of the bed is mounted by the bed heat-isolation member to the bed and a smooth pebble layer is additionally laid on the energy stone layer that is in direct contact with the bed heating member, it is possible to prevent a human body from directly contacting the bed heating member or the energy stone layer that might be of a high temperature, and also, the smooth pebble layer may take the place or cover the energy stone layer that is irregular to provide a smooth and rounded surface for contacting the human body and thus ensuring comfortable perception of contact and touch. Further, the covering chamber is provided with the chamber heating member on an inside thereof and upper and lower sides of the chamber heating member are respectively provided with the chamber heat-isolation member and the heat isolation element so as to completely avoid the potential risk of burning caused by unexpected touch of a user.

With the above technology, the problems of the prior art pebble bed sauna that a heating area of a human body is limited to a local region, the apparent temperature is not sufficient, a warming/heating resonant effect is poor, and burning may easily occur can be overcome to achieve the above advantages.

DETAILED DESCRIPTION OF THE PREFERRED EMBODIMENT

Figure 1:
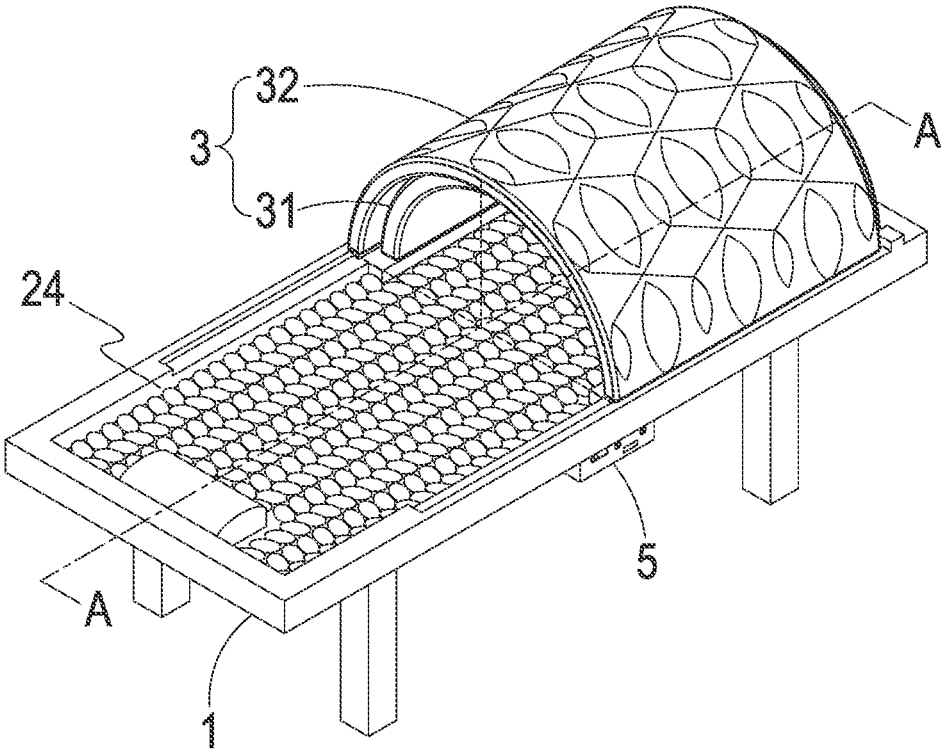
FIG. 1 is a perspective view of the present invention.
Figure 2:
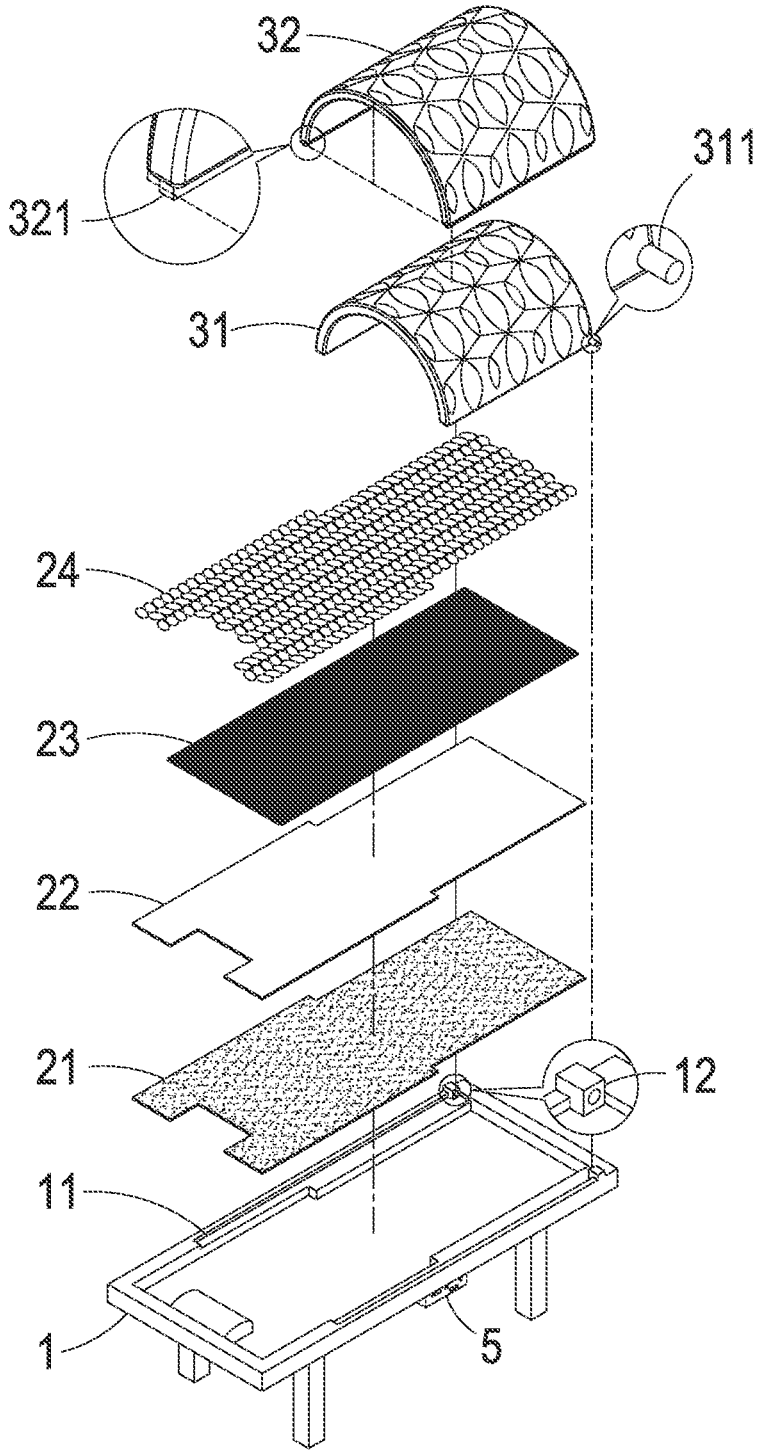
FIG. 2 is an exploded view of the present invention.
Figure 3:
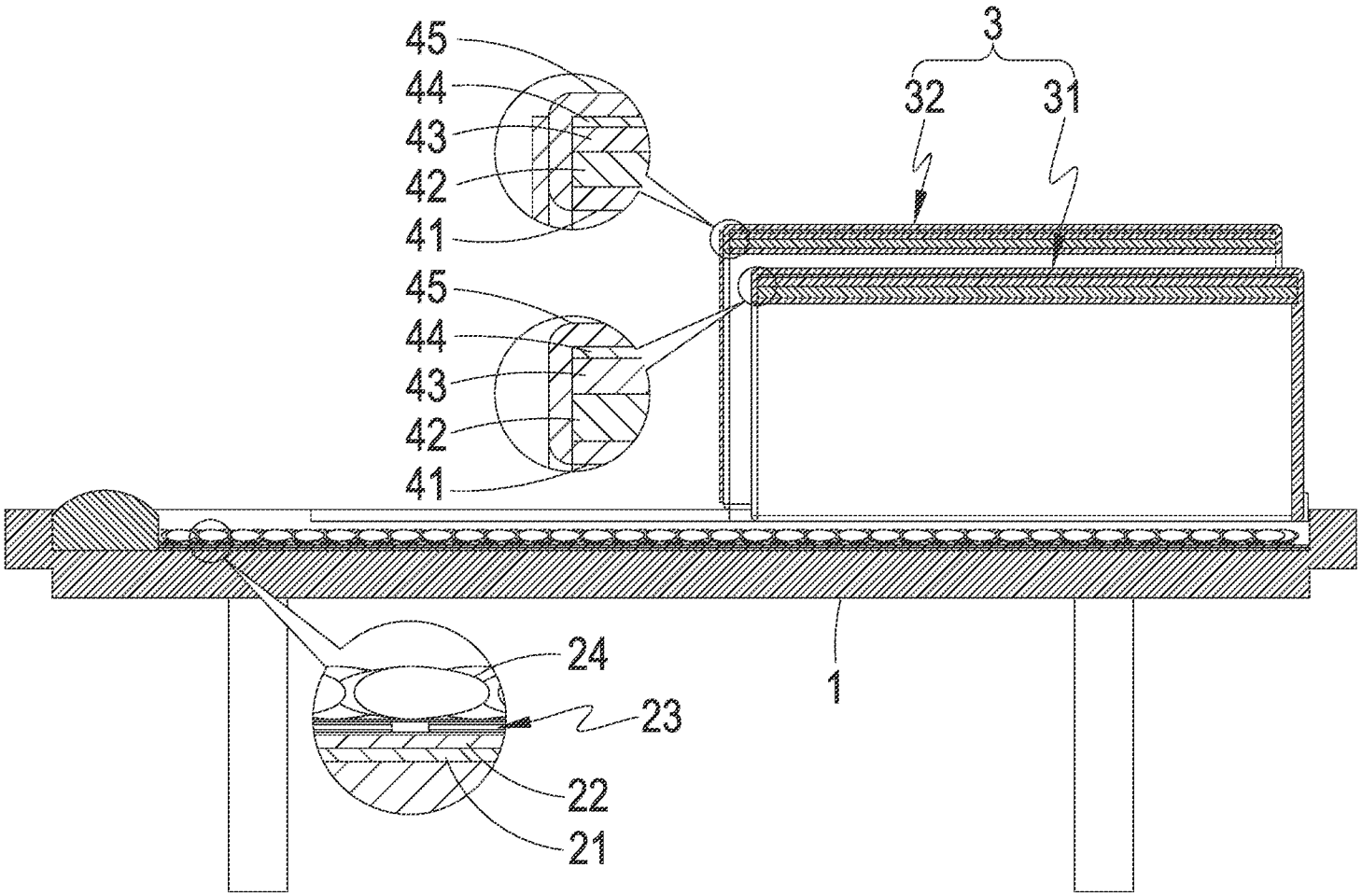
FIG. 3 is a cross-sectional view, taken along line A-A of FIG. 1.
Figure 4:
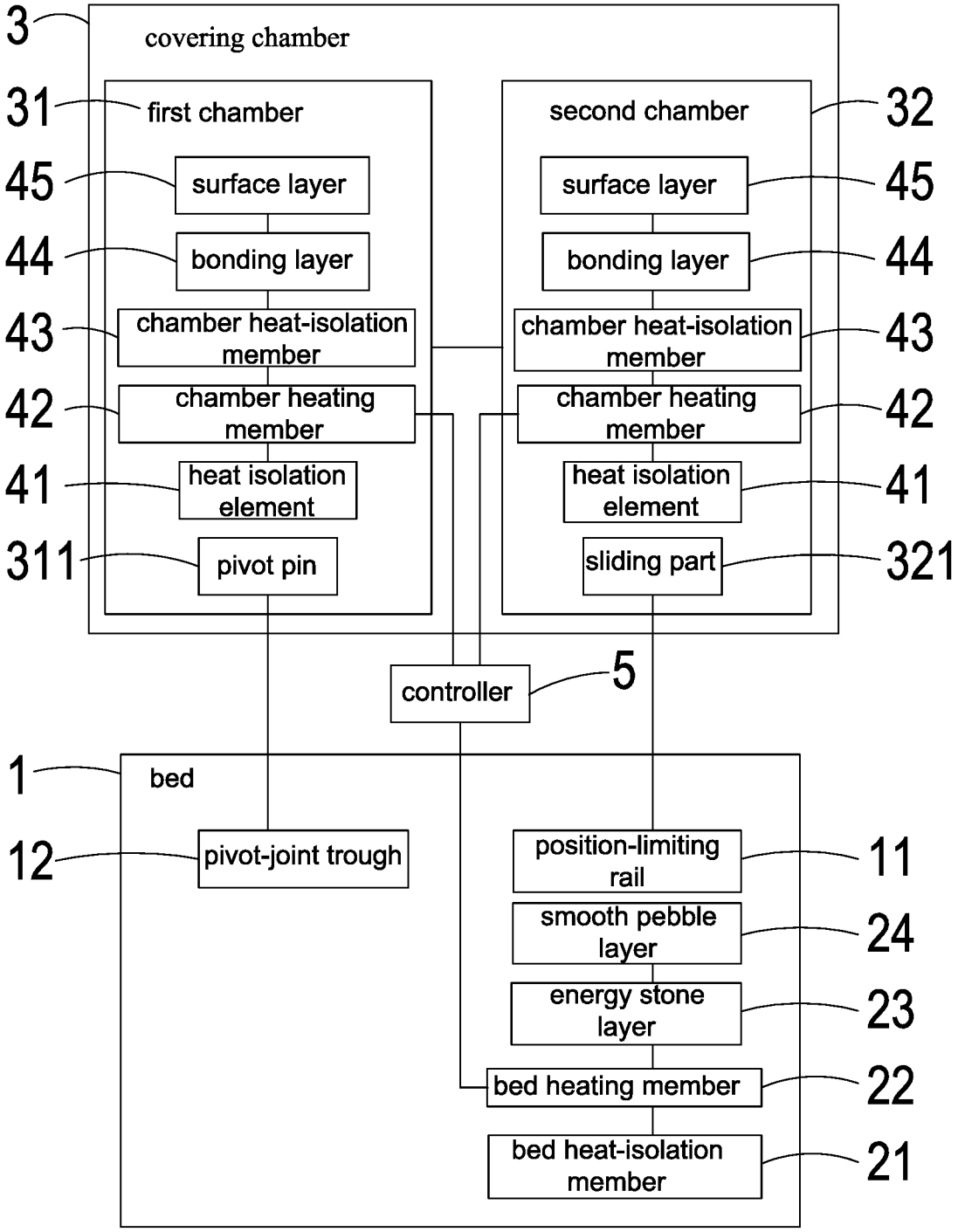
FIG. 4 is a block diagram of the present invention.

As shown in FIG. 1-4, the present invention comprises:

a bed 1, the bed 1 having two sides each formed with a position-limiting rail 11 and a pivot-joint trough 12;

at least one bed heating member 22 arranged on the bed 1;

at least one bed heat-isolation member 21 arranged between the bed 1 and the bed heating member 22;

a plurality of energy stone layers 23 arranged on one side of the bed heating member 22 that is distant from the bed heat-isolation member 21;

a plurality of smooth pebble layers 24 arranged on one side of the energy stone layer 23 that is distant from the bed heating member 22;

a covering chamber 3 movably disposed on the bed 1, the covering chamber 3 including a first chamber 31 pivotally mounted to the bed 1 and a second chamber 32 arranged on and covering the first chamber 31 and is movably disposed on the bed 1;

a plurality of pivot pins 311 provided on the first chamber 31 and pivotally mounted in the pivot-joint troughs 12;

a plurality of sliding parts 321 provided on the second chamber 32 and respectively corresponding to and coupled to the position-limiting rails 11;

at least one chamber heating member 42 arranged on the covering chamber 3;

at least one heat isolation element 41 arranged on one side of the chamber heating member 42 that is adjacent to the bed 1;

at least one chamber heat-isolation member 43 arranged on one side of the chamber heating member 42 that is distant from the heat isolation element 41;

at least one surface layer 45 formed on an outer surface of the covering chamber 3;

at least one bonding layer 44 arranged between the chamber heat-isolation member 43 and the surface layer 45; and a controller 5 arranged on the bed 1 and electrically connected to the bed heating member 22 and the chamber heating member 42.

As shown in FIGS. 1-7, the bed 1 is provided, in sequence from bottom to top, with the bed heat-isolation member 21, the bed heating member 22, the energy stone layers 23, and the smooth pebble layers 24, and the covering chamber 3 is formed of the surface layer 45, the bonding layer 44, the chamber heat-isolation member 43, the chamber heating member 42, and the heat isolation element 41 arranged in sequence from outside to inside and is controlled by the controller 5 that is arranged on the bed 1 and electrically connected to the bed heating member 22 and the chamber heating member 42 for a heating temperature thereof. An example of the bed heat-isolation member 21 and the chamber heat-isolation member 43 is needle-punched fabric; an example of the bonding layer 44 is glass fiber fabric; an example of the heat isolation element 41 is negative-ion mesh fabric; the energy stone layers 23 can be any combination of radium stones, volcanic rock, hokutolite, germanite, tenshoseki, chert; and the smooth pebble layers 24 can be any combination of cobblestone or Yuhua stone.

Figure 5:
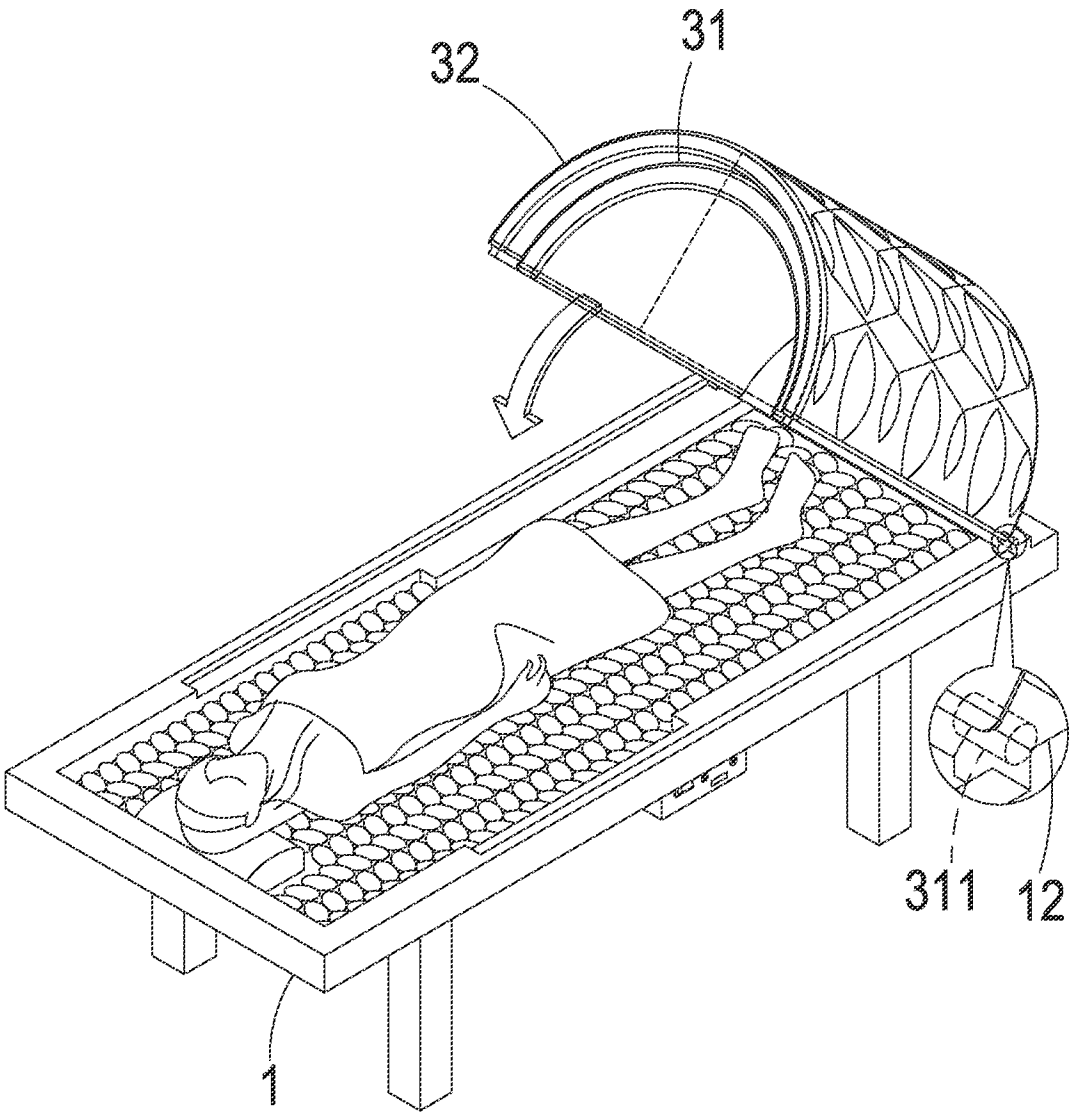
FIG. 5 is a schematic view illustrating movement of the present invention.
Figure 6:
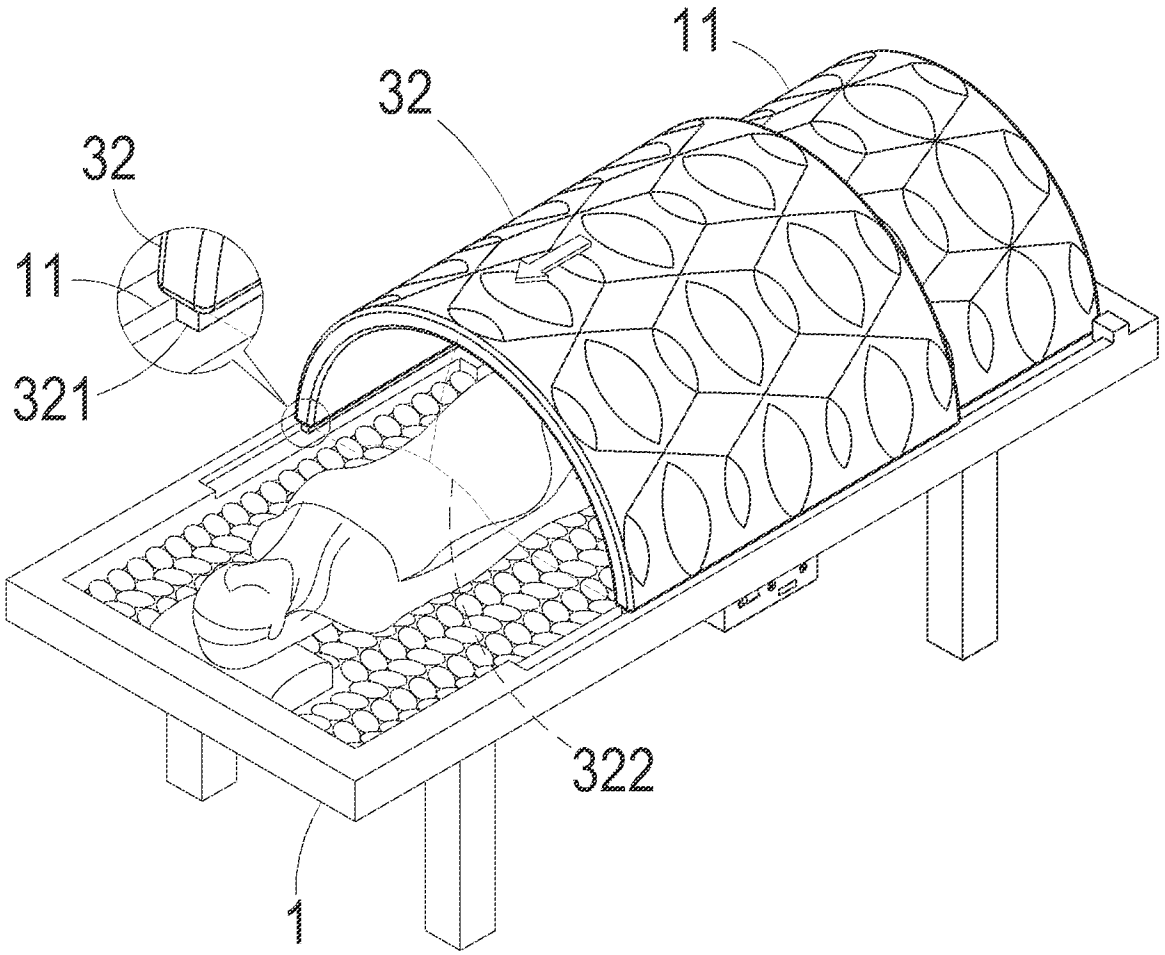
FIG. 6 is a schematic view illustrating covering according to the present invention.
Figure 7:
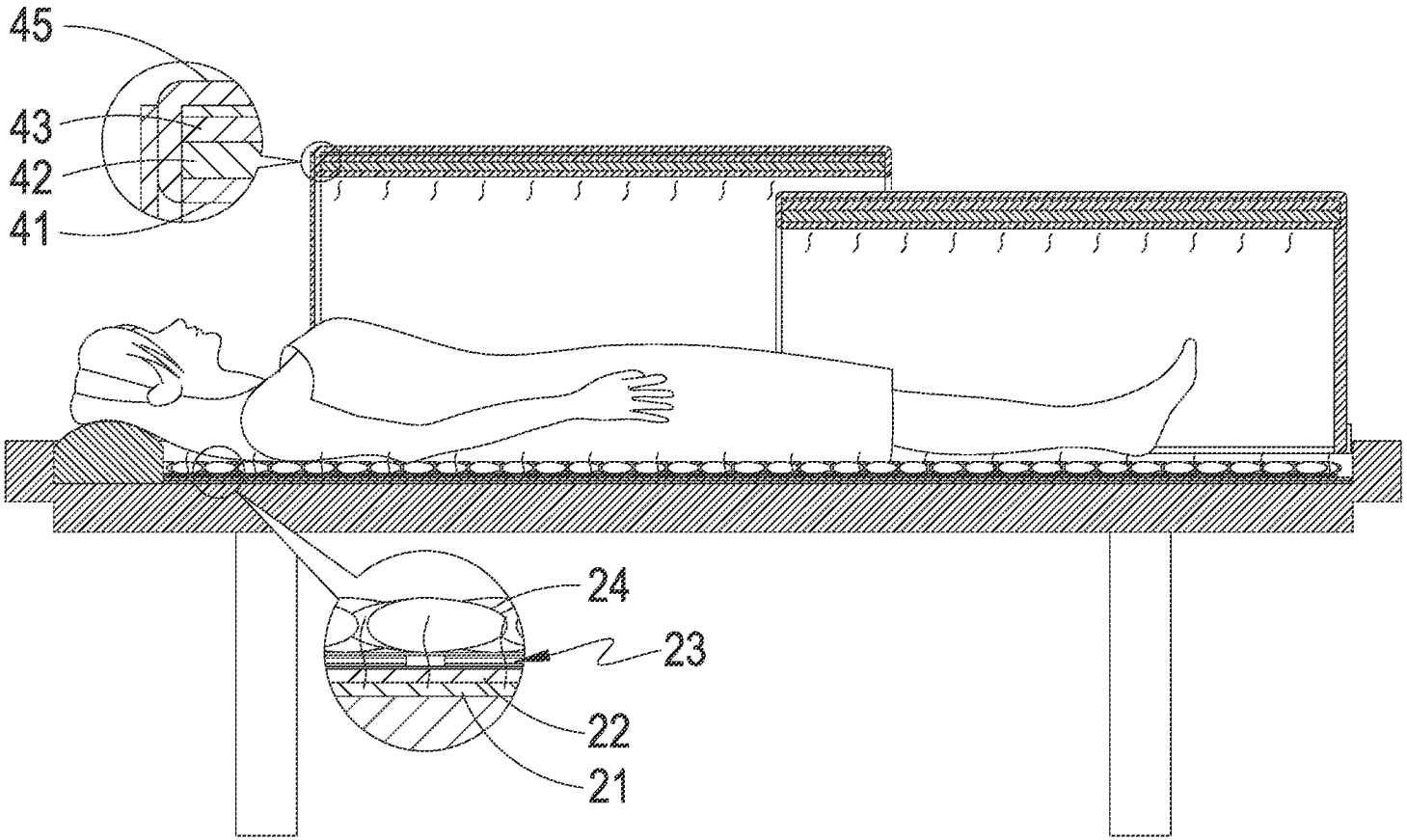
FIG. 7 is a schematic view illustrating heating according to the present invention.

In practical uses, as shown in FIGS. 5 and 6, to allow a person to smoothly lie on the bed 1, the sliding parts 321 of the second chamber 32 are caused to slide on the position-limiting rails 11 of the bed 1 (wherein, in this embodiment, the position-limiting rail 11 and the sliding part 321 are configured as a recess-and-projection arrangement for mutual engagement for position limiting), so that the second chamber 32 is arranged on and covers and overlaps the first chamber 31, and the pivot pins 311 of the first chamber 31 are caused to rotate in the pivot-joint troughs 12 to make the first chamber 31 rotated, about a rotation center defined by the pivot pins 311, to lift upward and open, and at the same time driving the second chamber 32 that is arranged on the first chamber 31 to open. The user lies down on the bed 1, and the first chamber 31 and the second chamber 32 are moved in opposite directions to have the first chamber 31 covering a lower half of the human body and the second chamber 32 covering an upper half of the human body. For a better warming/heating space, a covering member 322 may be provided at an open end of the second chamber 32 to collaborate with the covering chamber 3 to enclose hot air in the interior.

Since the bed heating member 22 of the bed 1 is fixed by the bed heat-isolation member 21 to the bed 1 and since the bed 1 is generally formed of a wooden frame, it is possible to reduce damages that the bed heating member 22 causes on the bed 1, and further, a smooth pebble layer 24 can be additionally laid on the energy stone layer 23 that is in direct contact with the bed heating member 22, wherein the smooth pebble layer 24 is formed of flat, smooth and rounded stones having smooth surfaces in order to take the place of the energy stone layer 23 that is irregular to prevent acute surface or corrugation of the energy stone layer 23 from contacting and touching human body, thereby providing comfortable perception of contact. Further, the covering chamber 3 is also provided, on an inner side thereof, with the chamber heating member 42, and upper and lower sides of the chamber heating member 42 are respectively provided with the chamber heat-isolation member 43 and the heat isolation element 41 to prevent burning caused by accidental contacts of the human body with the inside surface of the covering chamber 3, while on the upper side, high temperature is prevented from transmitting to the surface layer 45 to cause burning in case of contact with or touch on the covering chamber 3. In this way, potential risk of burning due to accidental contact of a user is completely avoided. Further, in the instant embodiment, the surface layer 45 is embodied as an example of being made of golden polyurethane (PU) leather, and for the synthetic PU leather, processing or treatment can be taken according to different strengths, abrasion resistances, coldness resistance, colors, glossiness, and patterns to include features of diversified textures, bettered water resistance, and neat and clear configuration and being of light weight, wear resistant, and skidding resistant, to further improve overall outside appearance and quality of the present invention.

Figure 8:
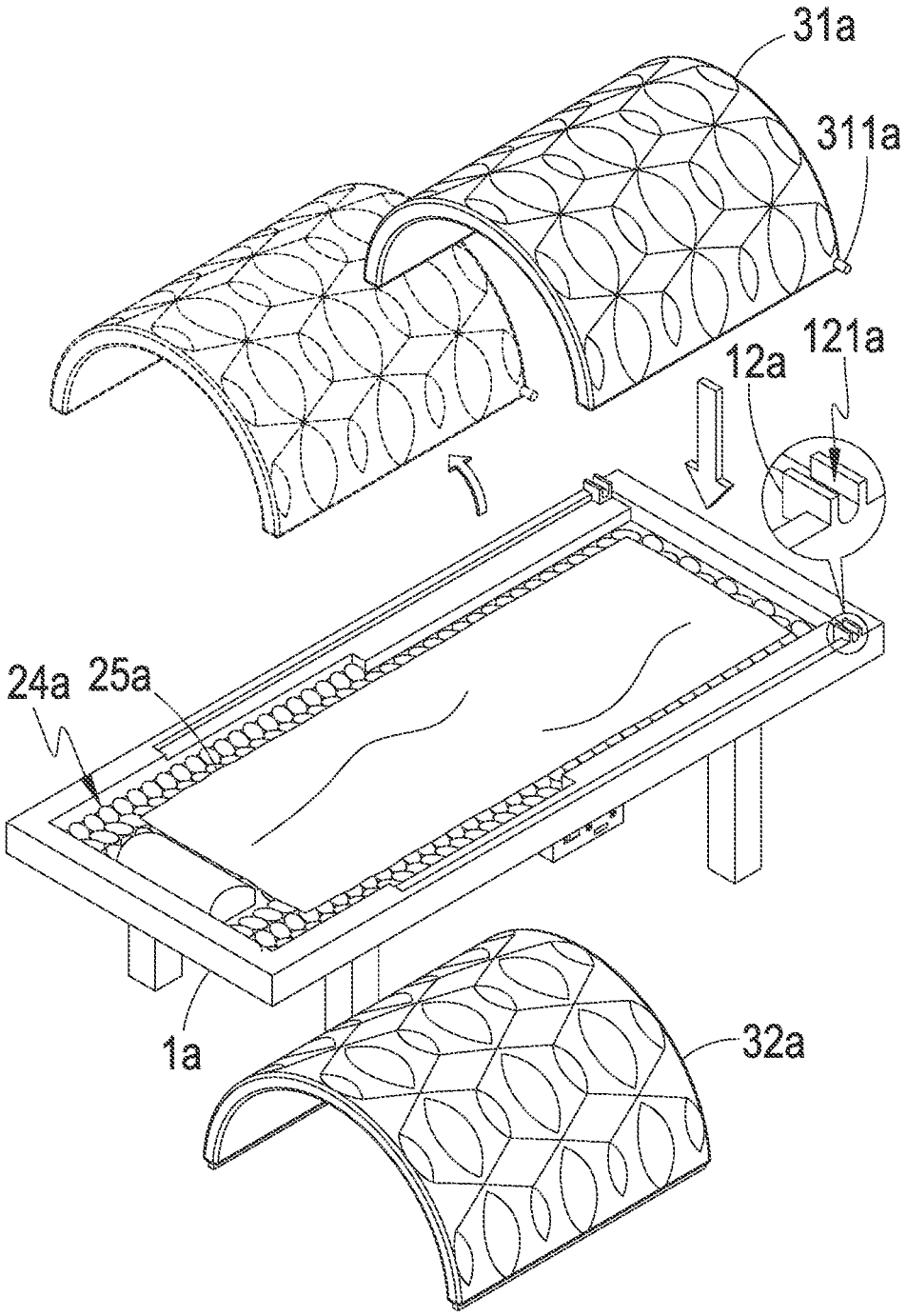
FIG. 8 is a schematic view illustrating another embodiment of the present invention.

As shown in FIG. 8, each of the pivot-joint troughs 12*a* is provided, at just one side thereof, with an opening 121*a* for easy separation of the pivot pin 311*a*. As such, a user can similarly makes use of rotation of the pivot pin 311*a* in the pivot-joint trough 12*a* to turn and open the first chamber 31*a*, and further, with the arrangement of the opening 121*a*, the pivot pin 311*a* can be removed out of the pivot-joint trough 12*a*, to make both the first chamber 31*a* and the second chamber 32*a* separable from the bed 1*a* for easy repairing/maintenance and cleaning to thereby improve security and sanitary of use. Also, for sanitary, it is advantageous, in use, to further provide a mat 25*a* (such as a towel) on the smooth pebble layers 24*a* in order to prevent undesired contact with dirt, sweat, and dander left by a previous user so as to remove sanitary concerns of other users.

Figure 9:
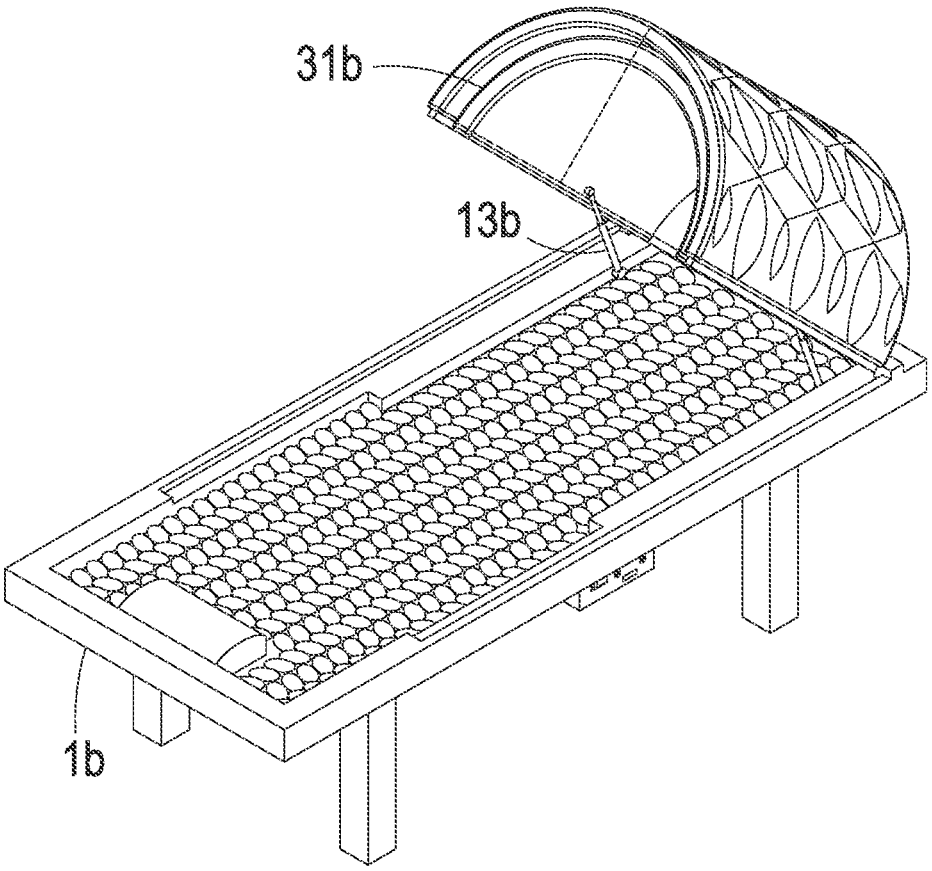
FIG. 9 is a schematic view illustrating a further embodiment of the present invention.

As shown in FIG. 9, at least one extendible/contractable bar 13*b* is provided only on the bed 1*b* to connect the first chamber 31*b* for opening/closing the first chamber 31*b* and fixing an opening angle thereof. The extendible/contractable bar 13*b* can be one of a hydraulic cylinder and a pneumatic cylinder. As such, a user may spend less effort in opening the first chamber 31*b* and unexpected falling of the first chamber 31*b*, after being opened, and thus colliding a user can be prevented to enhance operation safety and convenience.

I claim:

1. A pebble bed sauna device, comprising:

a bed;

at least one bed heating member arranged on the bed;

at least one bed heat-isolation member arranged between the bed and the bed heating member;

a plurality of energy stone layers arranged on one side of the bed heating member that is distant from the bed heat-isolation member;

a plurality of smooth pebble layers arranged on one side of the energy stone layer that is distant from the bed heating member;

a covering chamber movably disposed on the bed;

at least one chamber heating member arranged inside the covering chamber;

at least one heat isolation element arranged on one side of the chamber heating member that is adjacent to the bed;

at least one chamber heat-isolation member arranged on one side of the chamber heating member that is distant from the heat isolation element;

at least one surface layer formed on an outside surface of the covering chamber;

at least one bonding layer arranged between the chamber heat-isolation member and the surface layer; and a controller arranged on the bed and electrically connected to the bed heating member and the chamber heating member;

wherein the covering chamber includes a first chamber pivotally mounted to the bed and a second chamber arranged on and covering the first chamber and movably disposed on the bed such that the second chamber is selectively set on the first chamber and the first and second chambers are movable together relative to the bed;

wherein the bed has two sides each of which is provided with a pivot-joint trough, and the first chamber includes a plurality of pivot pins respectively arranged in the pivot-joint troughs; and wherein each of the pivot-joint troughs has a side that is formed with a side opening for removal of the pivot pin out of the pivot-joint trough by having the pivot pin moving through the side opening so as to separate the first and second chambers from the bed.

2. The pebble bed sauna device according to claim 1, wherein the bed has two sides each of which is provided with a position-limiting rail, and the second chamber includes a plurality of sliding parts respectively corresponding to and coupled to the position-limiting rails.

3. The pebble bed sauna device according to claim 1, wherein the bed includes at least one extendible/contractable bar connected to the first chamber for opening and closing the first chamber and fixing an opening angle thereof.

4. The pebble bed sauna device according to claim 1, wherein a mat is arranged on the smooth pebble layers.

* * * * *